US011407140B2

(12) United States Patent
Shellswell

(10) Patent No.: US 11,407,140 B2
(45) Date of Patent: Aug. 9, 2022

(54) PIVOTING RATCHET TOE BOARD

(71) Applicant: Norwood Industries Inc., Oro-Medonte (CA)

(72) Inventor: Brian Shellswell, Oro-Medonte (CA)

( * ) Notice: Subject to any disclaimer, the term of this patent is extended or adjusted under 35 U.S.C. 154(b) by 334 days.

(21) Appl. No.: 16/818,303

(22) Filed: Mar. 13, 2020

(65) Prior Publication Data

US 2020/0298437 A1 Sep. 24, 2020

(51) Int. Cl.

| | |
|---|---|
| ***B27B 5/22*** | (2006.01) |
| ***B27B 29/10*** | (2006.01) |
| ***B27B 1/00*** | (2006.01) |
| ***B27B 11/00*** | (2006.01) |
| ***B27B 31/06*** | (2006.01) |

(52) U.S. Cl.

CPC ..... *B27B 31/06* (2013.01); *B27B 1/00* (2013.01); *B27B 5/224* (2013.01); *B27B 11/00* (2013.01); *B27B 29/10* (2013.01)

(58) Field of Classification Search

CPC ..... B27B 11/00; B27B 5/224; B27B 29/10
See application file for complete search history.

(56) References Cited

U.S. PATENT DOCUMENTS

| | | | | |
|---|---|---|---|---|
| 2,850,130 | A * | 9/1958 | Mater | B27B 29/10 192/48.607 |
| 4,930,386 | A * | 6/1990 | Laskowski | B27B 31/04 83/928 |
| 8,261,645 | B2 | 9/2012 | Dale | |
| 8,820,727 | B2 | 9/2014 | Dale | |
| 9,102,074 | B2 | 8/2015 | Dale | |
| 9,676,116 | B2 | 6/2017 | Dale | |
| 2013/0283992 | A1* | 10/2013 | Belzile | B27B 15/02 83/648 |

FOREIGN PATENT DOCUMENTS

| | | | | |
|---|---|---|---|---|
| CA | 2687623 | A1 * | 7/2010 | B27B 29/08 |
| GB | 2118896 | A * | 11/1983 | B25B 5/127 |

OTHER PUBLICATIONS

Manual Toe Board (User Manual). 2018. Logosol. (Year: 2018).*
Byrne, William. "Rivoting Ratchet Toe Board: Requisition by the Examiner." Dec. 4, 2019. CIPO. (Year: 2019).*

* cited by examiner

*Primary Examiner* — Shelley M Self
*Assistant Examiner* — Katie L. Parr
(74) *Attorney, Agent, or Firm* — Calfee, Halter & Griswald LLP

(57) ABSTRACT

An adjustable toe board, an adjustable toe board assembly, kit and sawmill comprising the adjustable toe board are provided. The toe board comprises a baseplate having a first end, an opposed second end, and a rod extending away from the baseplate. The toe board includes a support bar pivotably coupled to the baseplate proximate the first end, spaced apart from the rod, and extending towards the second end, the support bar being configured to support a log. The toe board also includes a ratcheting arm pivotably coupled to the support bar, the ratcheting arm having a plurality of spaced-apart teeth defining notches adapted and positioned to selectively engage with the rod, wherein selective engagement of the teeth with the rod enables pivotal adjustment and releasable locking of the support bar relative to the baseplate during operation.

23 Claims, 9 Drawing Sheets

PIVOTING RATCHET TOE BOARD

CROSS-REFERENCE TO RELATED APPLICATION

This application claims priority from Canadian Patent Application No. 3037006 filed Mar. 18, 2019, which is incorporated by reference in its entirety.

FIELD

The specification relates to a toe board, a toe board assembly, a log support and clamp assembly having the toe board, a sawmill having the toe board and a kit containing the toe board.

BACKGROUND

Portable sawmills are generally small scale sawmills that may be moved to locations near the source of the logs. They allow hobbyists and craftsman to generate their own cut lumber.

Portable sawmills tend to include a saw head, a carriage, and a bed. In use, a log is disposed on the bed lengthwise. An operator then moves the saw head, using the carriage, along the length of the log. The saw head itself includes a continuous band saw blade wound around two rotating band wheels or a chainsaw. The saw head is affixed to the carriage, thereby allowing for relative movement of the blade with respect to the timber to be cut. The saw head also includes a gasoline or electric-powered engine or some other mover of the blade.

A typical portable sawmill bed includes two elongated, parallel rails having a plurality of cross-braces known as bunks. The lumber to be cut is supported on the bunks. However, logs to be cut may be tapered.

Cutting along the length of a tapered log as it sits on a horizontal bed of the above described portable sawmill tends to result in inefficient cutting and/or lower quality boards, since the saw head isn't cutting the log parallel to the heart or axis of the log. This may result in decreased lumber yield and decreased quality of the resulting boards, since the face of the cuts would not be parallel to the grain along the center of the log.

Existing toe boards may be used to lift the slimmer portion of the log to level out the center of the log parallel to the log deck. However, existing toe boards often include complex, hydraulic members or other relatively complex structures to facilitate the support and vertical adjustment. The complex structures add cost and complexity to the user, especially for small scale users, such as hobbyists and craftsmen.

SUMMARY

In one aspect, the specification discloses an adjustable toe board, comprising:

a baseplate having:

a first end, an opposed second end, and a rod extending away from the baseplate, a support bar pivotably coupled to the baseplate proximate the first end, spaced apart from the rod, and extending towards the second end, the support bar configured to support a log;

a ratcheting arm having a first arm end pivotably coupled to the support bar, the ratcheting arm having a plurality of spaced-apart teeth between said first end and a second end, said teeth defining notches adapted and positioned to selectively engage with the rod;

wherein selective engagement of the teeth with the rod enables pivotal adjustment and releasable locking of the support bar relative to the baseplate during operation.

In another aspect, the specification discloses an adjustable toe board assembly containing the toe board, as disclosed herein, one or more cross bunks and a side support.

In a further aspect, the specification discloses a sawmill containing the toe board, as disclosed herein, and a sawmill framework having a cross bunk.

In still further aspect, the specification discloses a kit containing the toe board, as disclosed herein.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
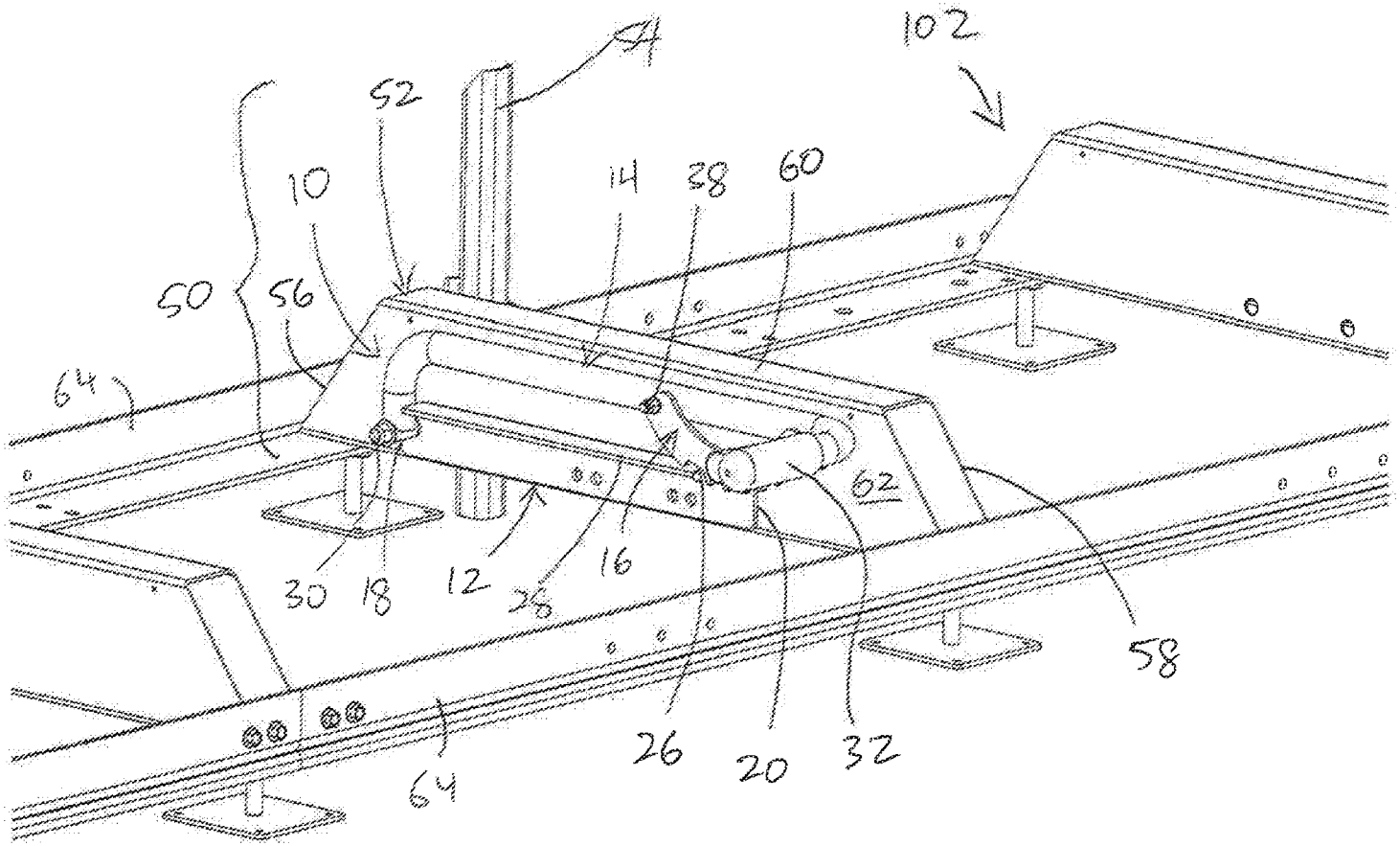
FIG. 1 shows a front perspective view of an adjustable toe board assembly in a first configuration incorporated into a portable sawmill bed in accordance with an embodiment as disclosed herein.

The Figures illustrate an embodiment of an adjustable toe board 10 in an adjustable toe board assembly 50, attached to a framework 102 of a sawmill 100. As best seen in FIGS. 1-4, adjustable toe board 10 is generally comprised of a baseplate 12, a support bar 14 pivotably coupled to baseplate 12, and a ratcheting arm 16 pivotably coupled to support bar 14.

Baseplate 12 is shown in the Figures to be rigid and generally elongate with a first end 18 and an opposed second end 20. Baseplate 12 further includes an inner face 22 and an opposed outer face 24, both which extend between first and second ends 18, 20. A rod 26 extends away from baseplate 12. In the depicted embodiment, rod 26 extends away from outer face 24, proximate second end 20.

To provide structural support for rod 26, baseplate 12 is shown to include a ledge 28 extending away from outer face 24. Ledge 28 is positioned immediately below rod 26. In this manner, downward force applied on rod 26 may also be resisted by ledge 28. While a generally rectangular baseplate 12 is shown in the Figures, the shape is not particularly limited.

Support bar 14 is configured for supporting a log 104. As shown, support bar 14 is pivotably coupled to baseplate 12 at first axle 30, which is positioned proximate first end 18 and spaced apart from rod 26. Support bar 14 extends from first axle 30 towards second end 20. In the depicted embodiment, support bar 14 extends from outer face 24 of baseplate 12.

In one embodiment, as disclosed herein, the support bar 14 can be provided with a handle 32 to assist with handling and maneuvering of support bar 14. The number and positioning of handle 32 is not particularly limited and can depend upon the application and design requirements. As shown in the Figures, for example, handle 32 is provided and coupled to the distal end of support bar 14, opposite first axle 30.

Support bar 14 is also shown to bend around ledge 28 and extends generally parallel to ledge 28 towards second end 20. However, the extension of support bar 14 towards second end 20 is not particularly limited to this configuration.

Ratcheting arm 16 is pivotably coupled to, and extends from, support bar 14 between first axle 30 and handle 32 via a second axle 38. Ratcheting arm 16 includes a plurality of spaced-apart teeth 34 which define notches 36. Ratcheting arm 16 is shown to have a generally curved and convex shape along the plurality of spaced-apart teeth. However, a different shape, such as a straight rectangular shape, may be used instead.

In one embodiment, as disclosed herein, the ratcheting arm 16 can be provided with a handgrip 40 at its distal end 42 to assist with handling and maneuvering of ratcheting arm 16. The number and positioning of handgrip 40 is not particularly limited and can depend upon the application and design requirements. As shown in the Figures, for example, handgrip 40 is provided and coupled to the distal end of support bar 14, opposite second axle 38.

Notches 36 are adapted and positioned to selectively engage with rod 26 of baseplate 12. The selective engagement of rod 26 with notches 36 enables pivotal adjustment and releasable locking of support bar 14 relative to baseplate 12 during operation.

In the embodiment shown, spaced-apart teeth 34 are adapted to enable movement of ratcheting arm 16 in one direction when toe board 10 is releasably-locked in position during operation. One manner in which this may be achieved is that teeth 34 slope from support bar 14 towards distal end 42. However, other configurations, for instance where teeth 34 extend away from distal end 42, can also be possible, so long as they maintain the desired function. In an embodiment the teeth slope towards the arm end opposite the pivoting arm end.

Figure 5:
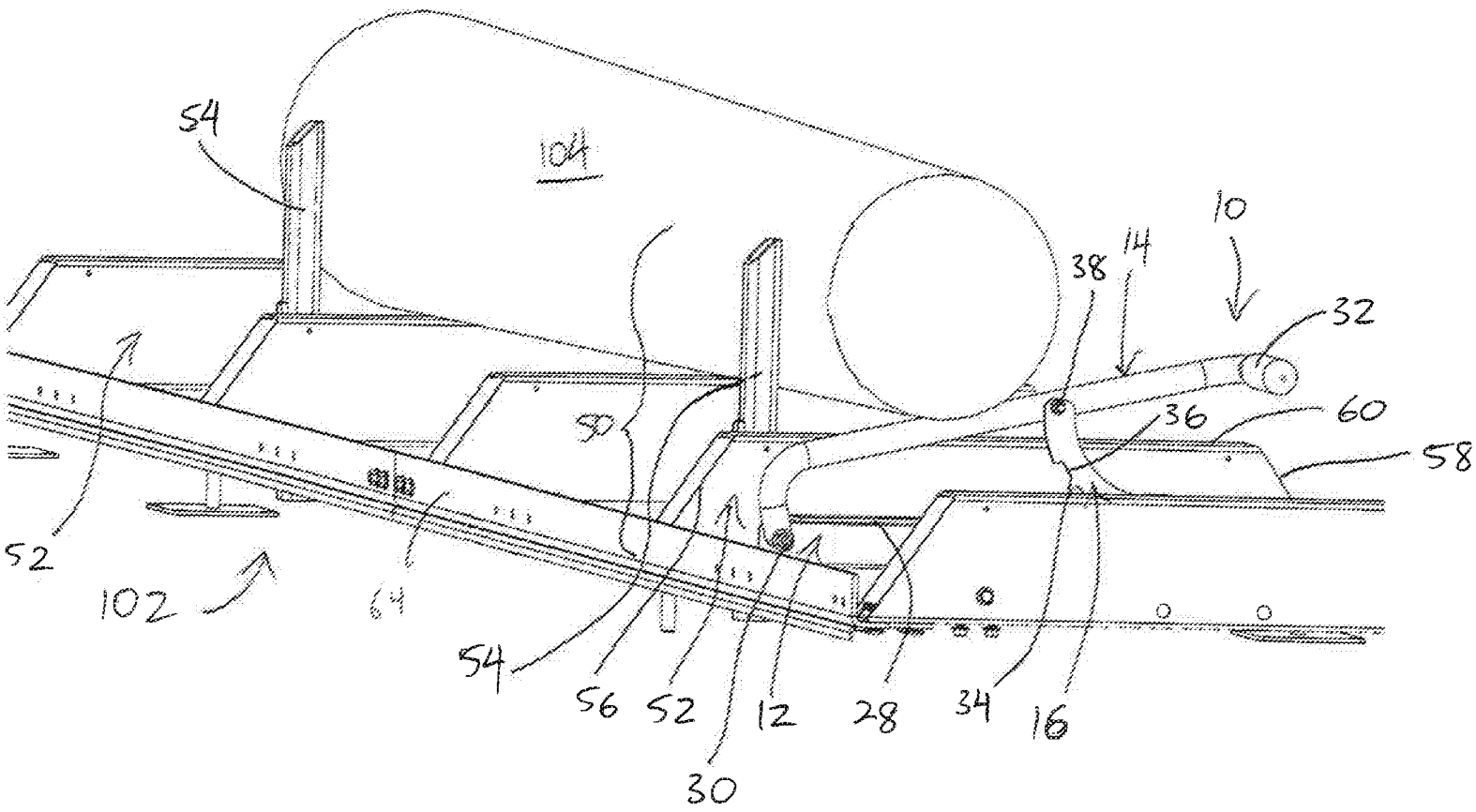
FIG. 5 shows a front perspective view of the adjustable toe board assembly of FIG. 2 in use with a log.

The combination of teeth 34 on ratcheting arm 16 with notches 36 along with rod 26 provides for a ratchet-type mechanism that allows movement of ratcheting arm 16 in one direction, while preventing movement of ratcheting arm 16 in the opposite direction by releasably-locking ratcheting arm 16 in position during operation. In the embodiment shown in the Figures, the ratcheting-type mechanism allows movement of ratcheting arm 16 upwards, away from baseplate 12. The coupling between ratcheting arm 16 and support bar 14 results in support bar 14 also pivoting away from baseplate 12 and to be raised above top edge 60 to engage log 104 (see FIG. 5 for example). A downward force applied to support bar 14 due to gravity and/or the log can help to retain rod 26 in one of notches 36, thereby helping to prevent movement of support bar 14 from pivoting back down below top edge 60.

Teeth 34 disclosed in the embodiment have a generally flat profile, however, other shapes, such as for example and without limitation, an arcuate profile, is also possible.

The number and position of teeth 34 are also not particularly limited. As shown in the embodiment disclosed herein, teeth 34 are arranged along a portion of one side or edge of ratcheting arm 16 from its distal end 42. While not shown in the Figures, other teeth configurations are possible. For example, rather than being arranged along one side or edge of ratcheting arm 16, teeth 34 may instead by formed within a slot within ratcheting arm 16, so long as the teeth 34 can operatively couple with rod 26 for releasably-locking toe board 10 in place during operation, as described further herein.

The spacing between teeth 34 is not particularly limited, so long as they are spaced-apart enough to accommodate rod 26, and permit rod 26 to engage a notch 36, which would allow the movement of ratcheting arm 16, and thereby support bar 14, in one direction and also releasably-lock toe board 10 in position during operation.

For example, as shown in FIG. 1, toe board 10 is in a first configuration, wherein toe board 10 would not be engaged with a log sitting on framework 102. Here, rod 26 is engaged with, or fitted into, the innermost notch 36 (furthest from distal end 42) of ratcheting arm 16 where first and second axles 30 and 38 are pivoted such that support bar 14 is positioned generally parallel with ledge 28.

Figure 2:
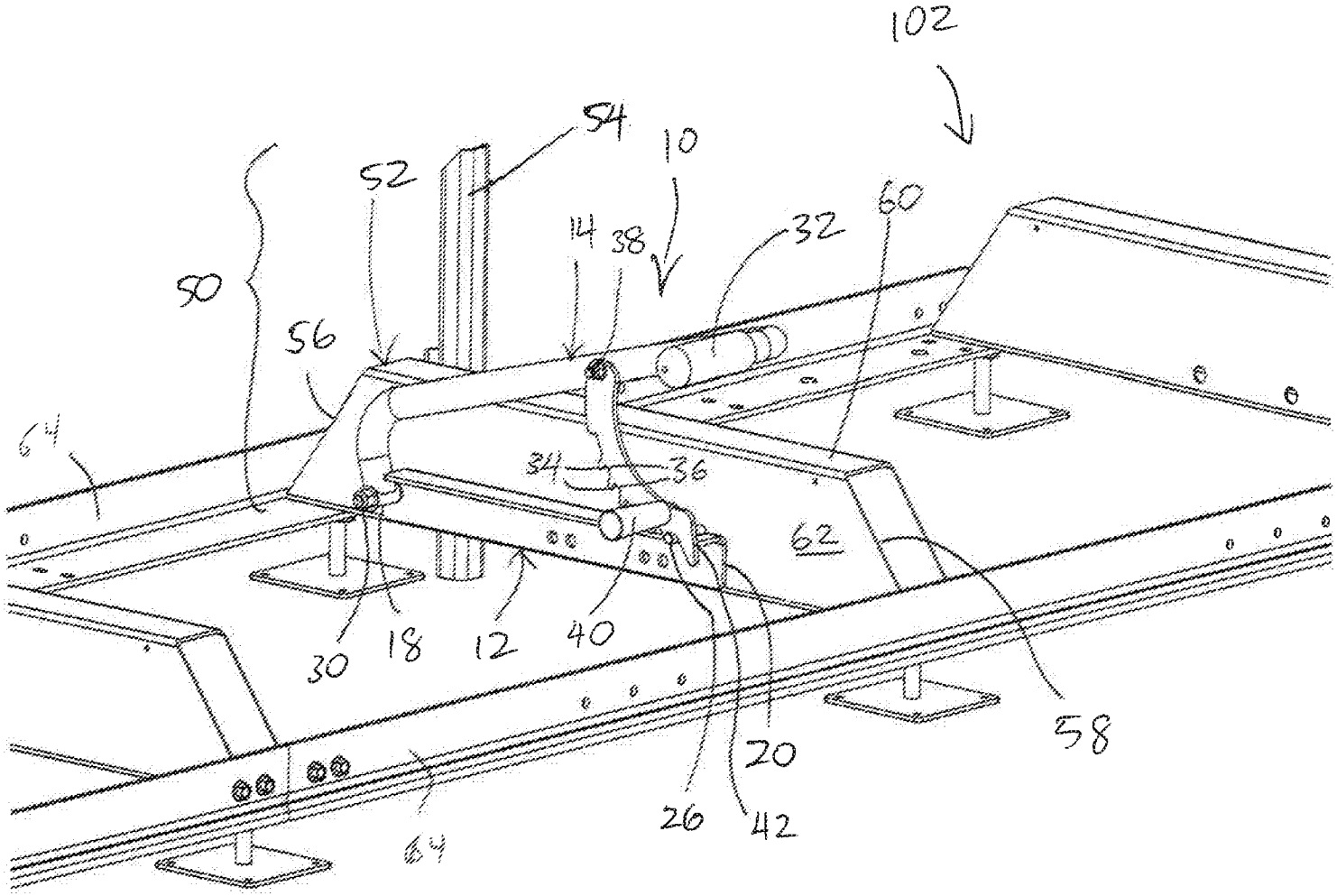
FIG. 2 shows the adjustable toe board assembly of FIG. 1 in a second configuration.

As shown in FIG. 2, toe board 10 is in a second configuration, wherein toe board 10 would be engaged with a log sitting on framework 102. Here, rod 26 is engaged with, or fitted into, the outermost notch 36 (closest to distal end 42) of ratcheting arm 16. In this manner, first and second axles 30 and 38 are pivoted such that support bar 14 is positioned at an angle relative to ledge 28.

A skilled person would further understand that toe board 10 may be positioned into multiple other configurations between the first and second configurations shown. The multiple other configurations allow support bar 14 to be positioned at multiple, different incremental angles relative to ledge 28.

Figure 3:
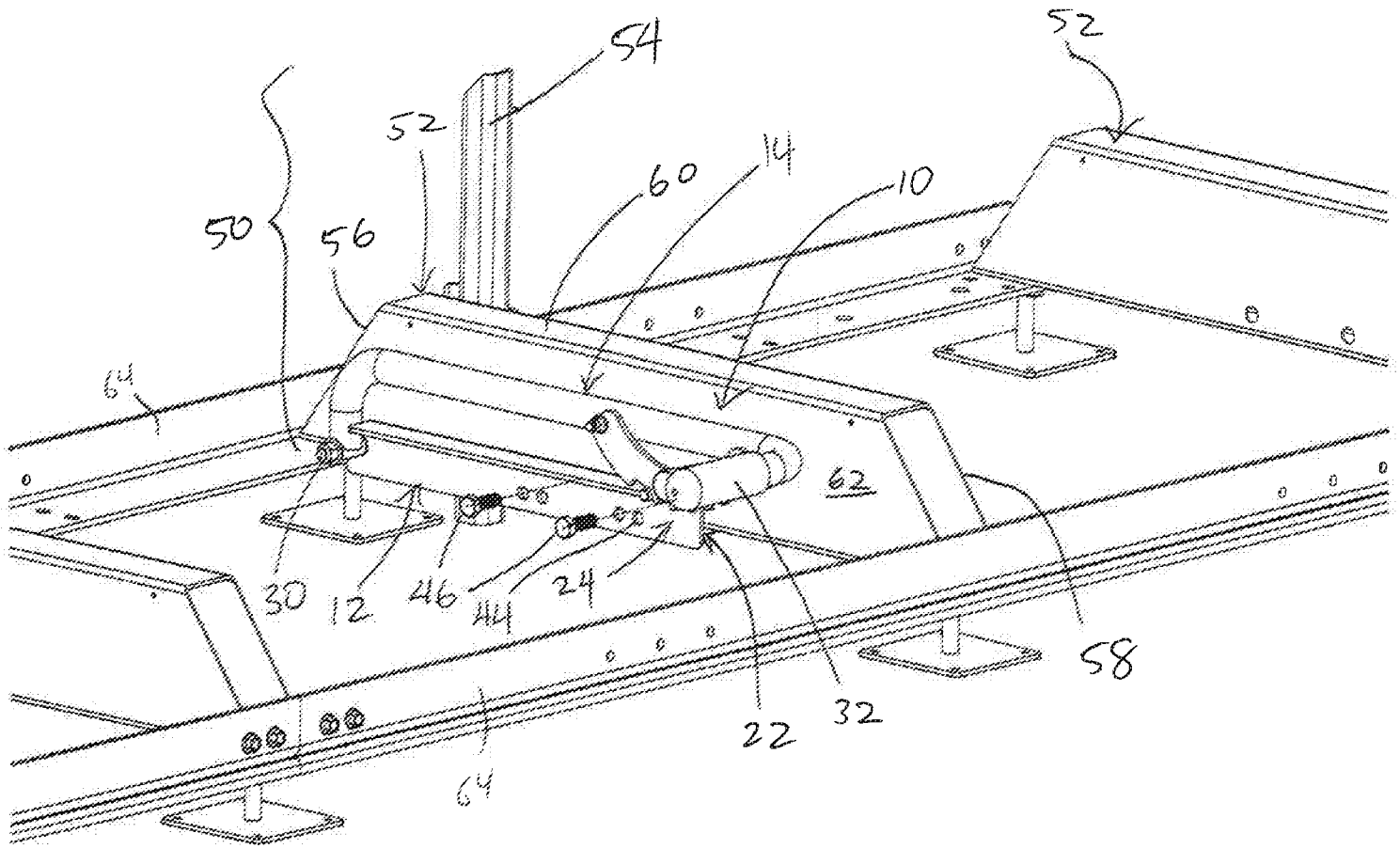
FIG. 3 shows a partial exploded view of the adjustable toe board assembly of FIG. 1.
Figure 4:
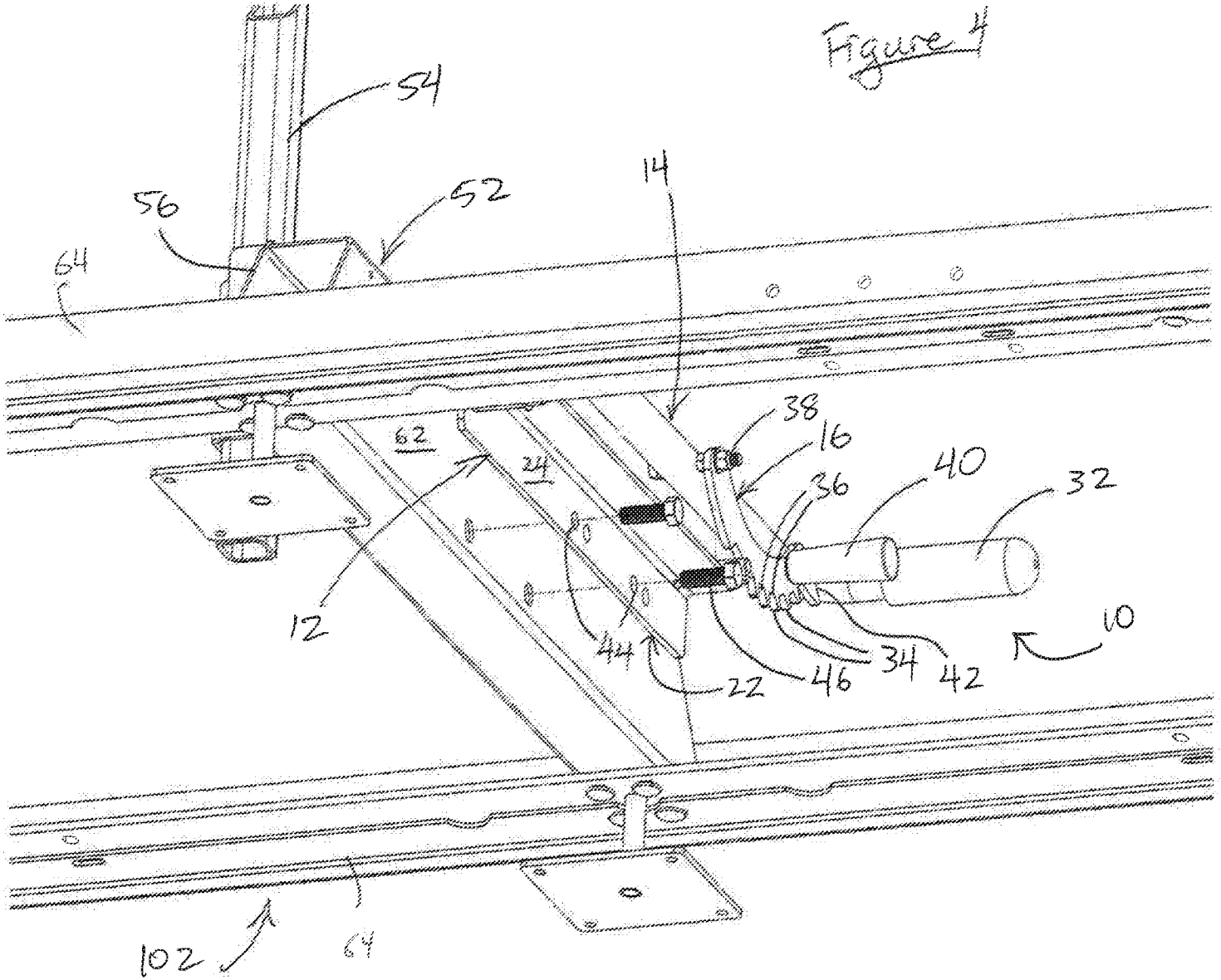
FIG. 4 shows a bottom perspective view of the partially exploded adjustable toe board assembly of FIG. 3.

In the present embodiment, baseplate 12 has apertures 44 through which fasteners 46 may be received in order to secure toe board 10 to framework 102 of sawmill 100 (see FIGS. 3-4).

In an alternate embodiment, not shown in the Figures, adjustable toe board 10 may not have a baseplate. In such a case, rod 26 and support bar 14 may be coupled directly to a cross member 64 of framework 102. In such an embodiment, support bar 14 may be pivotably secured proximate an end of the cross member 64, and rod 26 may be secured proximate an opposite end of the cross member 64, i.e. they may be spaced apart such that ratcheting arm 16 can engage rod 26. In this manner, the cross member 64 would act as the baseplate.

Toe board 10 may be provided as a separate apparatus. Toe board 10 may also be provided as part of an adjustable toe board assembly 50 or a kit containing components of toe board 10. In addition, toe board 10 may also be used as part of sawmill 100.

As best seen in FIGS. 1-4, toe board 10 as described above may form part of adjustable toe board assembly 50 or a kit. Adjustable toe board assembly 50 may further include a toe board frame having one or more cross members 64 or cross bunks 52 and a log rest 54. The log rest is for supporting the log at the side of the bunk. Each cross bunk 52 has a first bunk end 56, a second bunk end 58, a top edge 60 extending therebetween for supporting a log, and a bunk side 62. Log rest 54 is secured proximate first bunk end 56 of one of cross bunks 52 for engaging log 104.

In the depicted embodiment, adjustable toe board 10 is secured to bunk side 62 of cross bunk 52, where first end 18 of baseplate 12 is secured proximate first bunk end 56 of the corresponding cross bunk 52. Adjustable toe board 10 is further shown to be secured to a bottom portion of side 62.

In this manner, when toe board 10 is in the first configuration (see FIG. 1 for example), support bar 14 is positioned generally parallel with, and below, top edge 60. Accordingly, when a log is seated on top edge 60, support bar 14 does not provide support to the log, but top edge 60 does.

When toe board 10 is in the second configuration (see FIG. 2 for example), the pivotal movement of support bar 14 places support bar 14 at an angle relative to ledge 28 and partially above top edge 60 of the corresponding cross bunk 52 in operation. Support bar 14 thus comes into contact and engagement with log 104, lifting the corresponding portion of log 104 above top edge 60 and directing log 104 towards log rest 54. Log rest 54 provides a stationary side stop against which the log or timber may be held. Gravity helps to retain log 104 in position between log rest 54 and support bar 14. See FIGS. 6-9 showing toe board 10 in use with log 104.

While log rest 54 is shown to extend generally perpendicular from cross bunk 52 in the depicted embodiment, log rest 54 may alternately be secured at a different angle to cross bunk 52, so long as log rest 54 continues to act as a stationary side stop for log 104.

Changing the engagement of notches 36 with rod 26 increases or decreases the angle of support bar 14 relative to baseplate 12 and to top edge 60. A greater angle between support bar 14 and top edge 60 tends to increase the height at which support bar lifts its corresponding portion of log 104 above top edge 60. Conversely, a smaller angle between support bar 14 and top edge 60 results in support bar 14 lifting log 104 to a smaller height, or not at all, above top edge 60.

Figure 6:
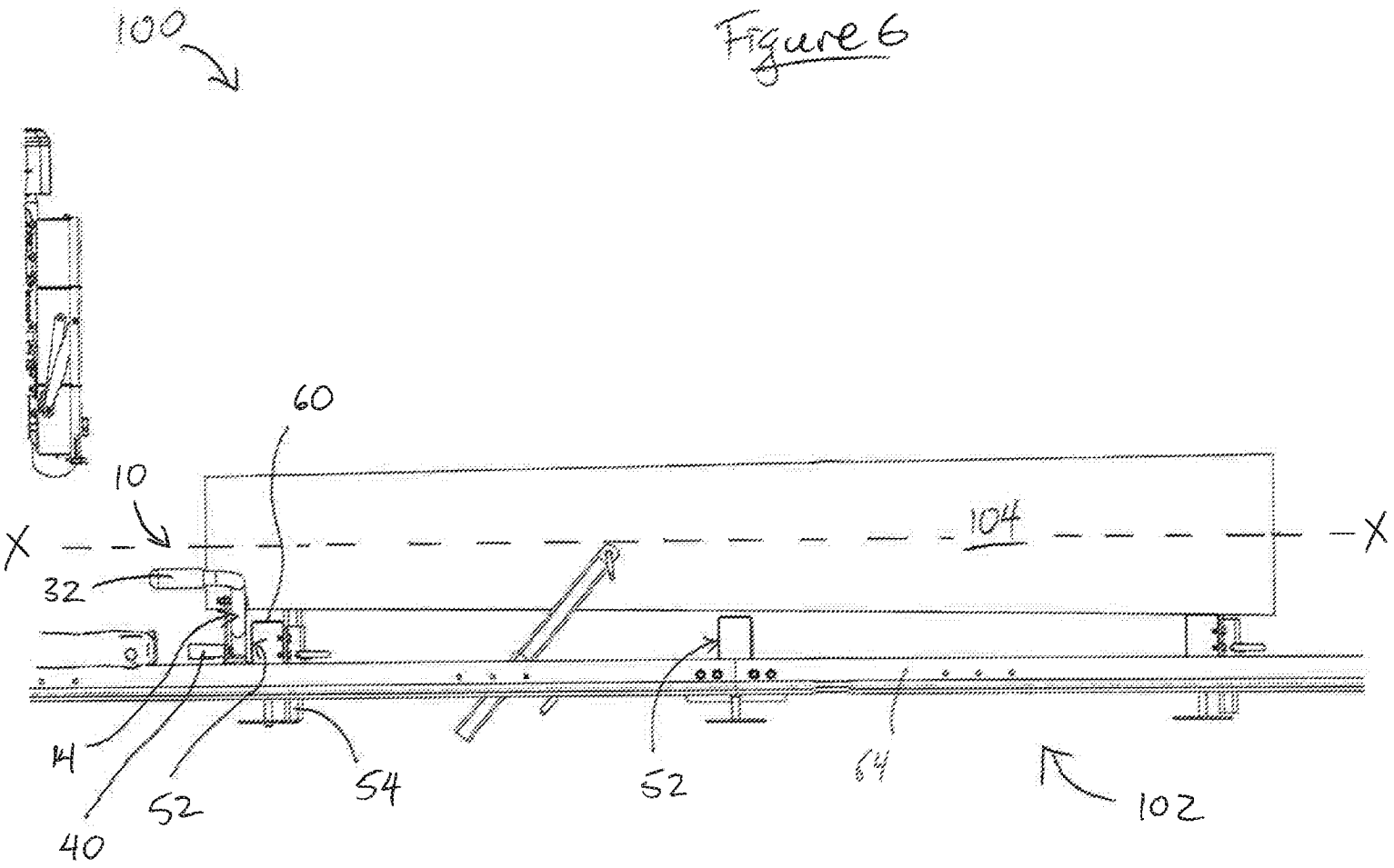
FIG. 6 shows an elevational side view of the adjustable toe board assembly of FIG. 5 in use with a portable sawmill.
Figure 7:
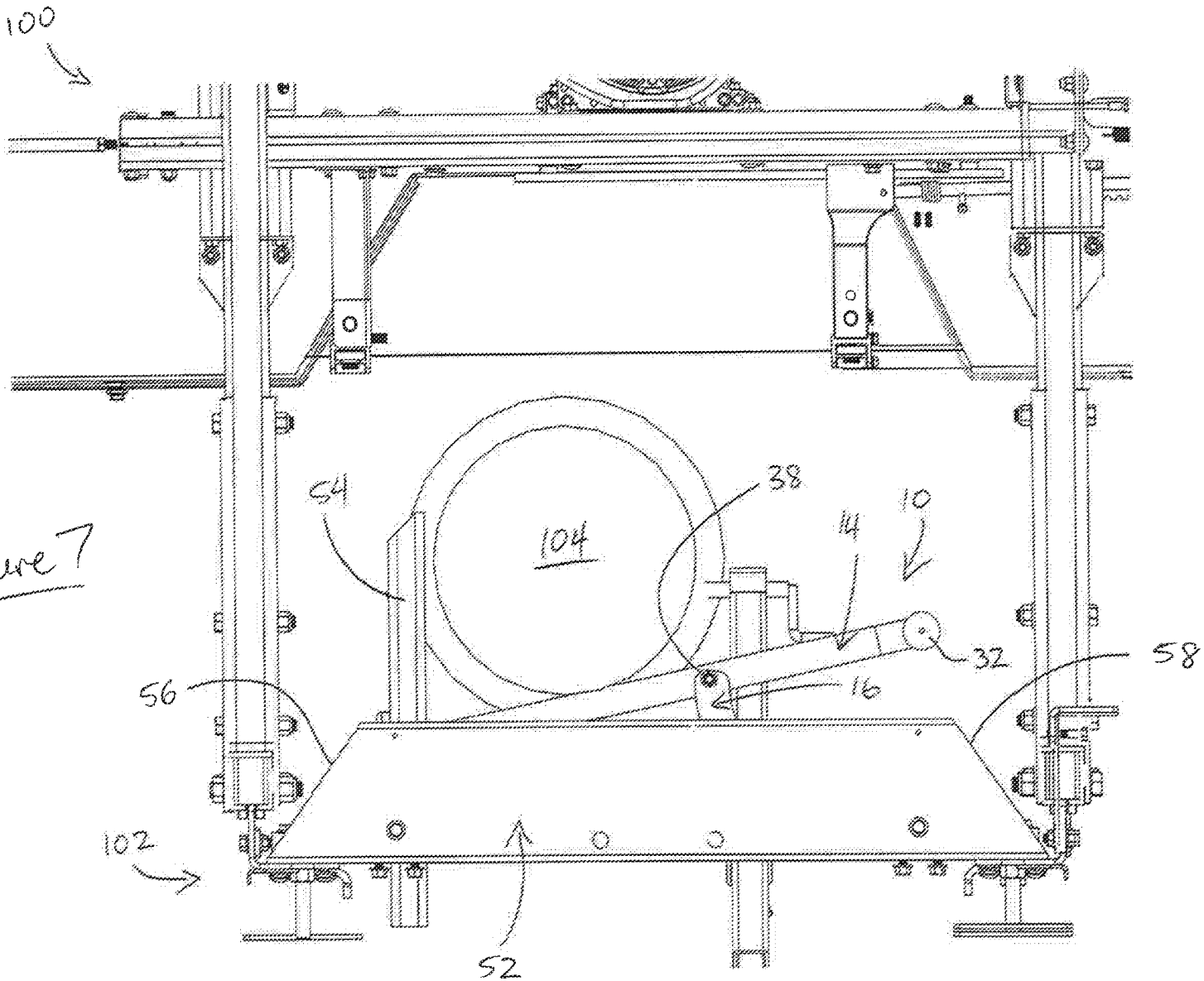
FIG. 7 shows an elevational front view of the adjustable toe board assembly of FIG. 6 with the portable sawmill.
Figure 8:
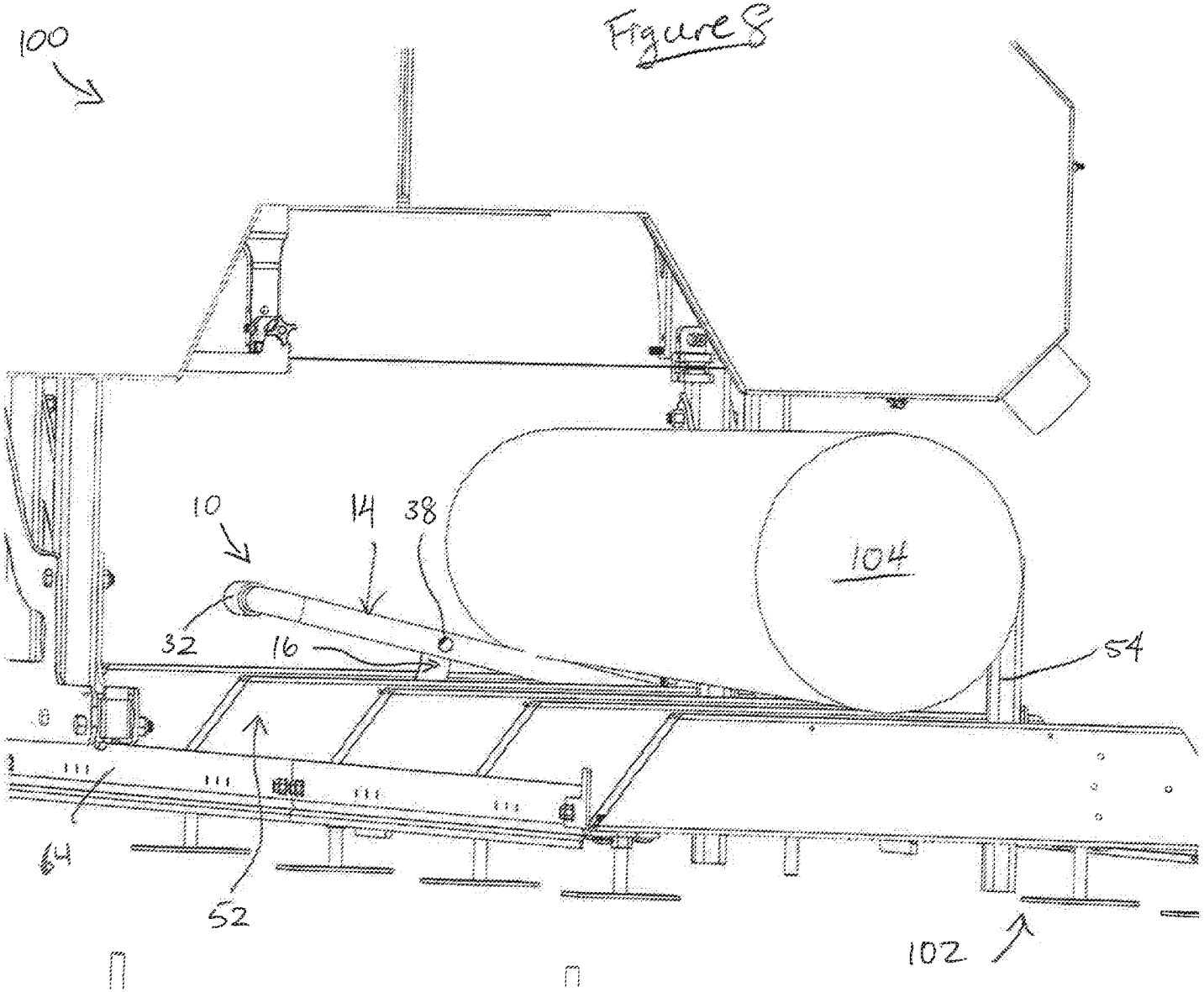
FIG. 8 shows a back perspective view of the adjustable toe board assembly of FIG. 7 with the portable sawmill.
Figure 9:
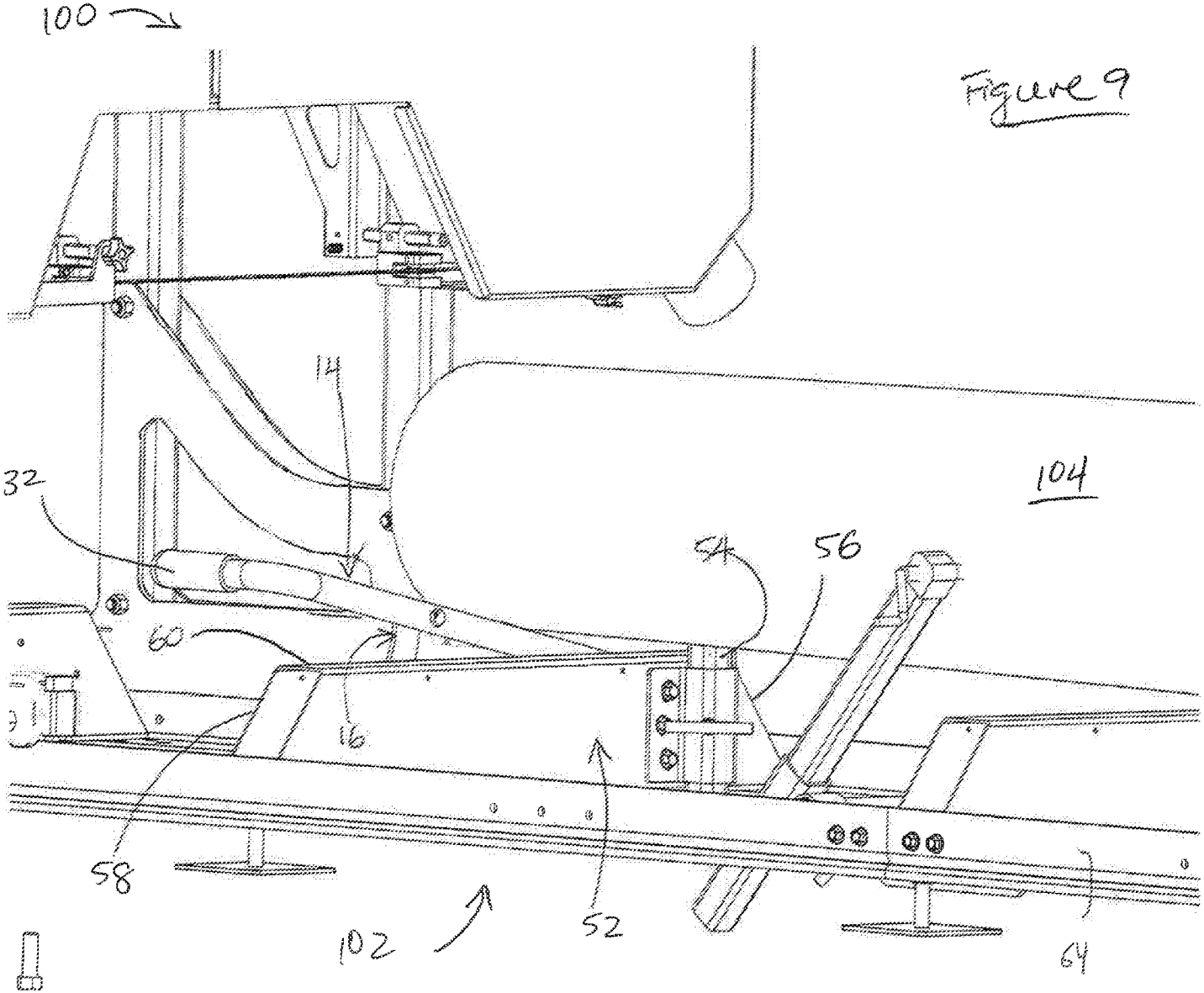
FIG. 9 shows a partial enlarged view of the adjustable toe board assembly of FIG. 8.

In this manner, given the availability of multiple possible combination of notches 36 with rod 26, a user may incrementally adjust the height of the smaller end of log 104 relative to framework 102 in order to level out the center or axis X-X of log 104 to make it generally parallel to the log deck of framework 102 and maintain log 104 in the levelled position for milling (see FIG. 6 for example).

The number and size of the possible incremental height adjustments implemented by toe board 10 may be varied depending on the number, positioning and size of teeth 34 on ratcheting arm 16.

The positioning of adjustable toe board 10 on cross bunk 52 is not particularly limited, so long as support bar 14 may be positioned to allow support bar 14 to extend below and above top edge 60 when desired.

In the present embodiment, log rest 54 and toe board 10 are secured to the same cross bunk 52. In an alternate embodiment, not shown in the Figures, log rest 54 and toe board 10 may be secured to different cross bunks 52.

The shape and material of construction of the toe board frame is not particularly limited, so long as toe board 10 can be attached to it and the toe board frame can be used for holding toe board 10 and engaging toe board 10 with a log.

As noted above, adjustable toe board 10 may not have a baseplate. In such a case, rod 26 and support bar 14 may be coupled directly to cross bunk 52 in toe board assembly 50. In such an embodiment, support bar 14 may be pivotably secured proximate an end of the cross member 64 spaced apart from rod 26. In this manner, cross bunk 52 would act as the baseplate.

Toe board 10, toe board assembly 50 and the kit can be particularly suitable for portable sawmills, and for use by woodworkers, "do-it-yourselfers", and people situated in remote areas, who would like to saw boards of higher quality, since it allows for tapered logs to be leveled for cutting.

The multiple, possible incremental adjustments of toe board 10 also allow toe board 10 to be used with logs having different levels of taper. For example, a log with a greater taper may require its slimmer end to be lifted to a greater height for its axis to be generally parallel with that of the mill bed. In such a case, support bar 14 may be lifted, and a corresponding notch 36 is brought into engagement with rod 26 to lift support bar 14 at a greater angle above top edge 60 to increase the height at which support bar lifts the slimmer portion of log 104 above top edge 60.

In addition to the above, another benefit is that it is a simple design that is simple to use and more economical.

Certain adaptations and modifications of the described embodiments can be made. Therefore, the above discussed embodiments are considered to be illustrative and not restrictive.

While a number of exemplary aspects and embodiments have been discussed above, those of skill in the art will recognize certain modifications, permutations, additions and combinations thereof. It is therefore intended that the following appended claims and claims hereafter introduced are interpreted to include all such modifications, permutations, additions and combinations as are consistent with the broadest interpretation of the specification as a whole.

TABLE OF ELEMENTS toe board 10
baseplate 12
support bar 14
ratcheting arm 16
first end (baseplate) 18
second end (baseplate) 20
inner face 22
outer face 24
rod 26
ledge 28
first axle 30
handle 32
teeth 34
notches 36
second axle 38
handgrip 40
distal end (ratcheting arm) 42
aperture 44
fastener 46
toe board assembly 50
cross bunk 52
side support 54
first bunk end 56
second bunk end 58
top edge 60
bunk side 62
cross member 64
sawmill 100
framework 102
log 104

What is claimed is:

1. An adjustable toe board, comprising:

a baseplate having:

a first end, a second end, and a rod extending from the baseplate, a support bar pivotably coupled to the baseplate proximate the first end, spaced apart from the rod, and extending towards the second end, the support bar configured to support a log;

a ratcheting arm having a first arm end pivotably coupled to the support bar, the ratcheting arm having a plurality of spaced-apart teeth defining notches adapted and positioned between the first arm end and a second arm end to selectively engage with the rod;

wherein selective engagement of the teeth with the rod enables pivotal adjustment and releasable locking of the support bar relative to the baseplate during operation.

2. The adjustable toe board according to claim 1, the baseplate further comprising an inner face and an opposed outer face, the inner and outer faces extending between the first and second ends, wherein the rod and the support bar extend away from the outer face, the baseplate further comprising a ledge extending away from the outer face, the ledge positioned immediately below the rod for supporting the rod.

3. The adjustable toe board according to claim 2, wherein the rod is positioned proximate the second end.

4. The adjustable toe board according to claim 2, wherein the ratcheting arm is curved and convex along the plurality of spaced-apart teeth.

5. The adjustable toe board according to claim 1, wherein the spaced-apart teeth are adapted to enable movement of the ratcheting arm in one direction when the toe board is releasably-locked in position during operation.

6. The adjustable toe board according to claim 1, wherein the teeth slope towards the second arm end.

7. The adjustable toe board according to claim 6, wherein the teeth have an arcuate profile.

8. The adjustable toe board according to claim 1, wherein the support bar includes a handle.

9. The adjustable toe board according to claim 1, wherein the ratcheting arm includes a handgrip.

10. The adjustable toe board according to claim 1, wherein the baseplate is securable to a cross member of a sawmill.

11. An adjustable toe board assembly, comprising:

one or more cross bunks, each having a first bunk end, a second bunk end, and top edge extending therebetween for supporting a log; and a side support secured proximate the first bunk end of one of the cross bunks for engaging the log; and an adjustable toe board secured to one of the cross bunks, the toe board comprising:

a baseplate having a first end and a second end, and a rod extending from the baseplate, a support bar having a first arm end pivotably coupled to the baseplate proximate the first end, spaced apart from the rod, and extending towards a second arm end, the support bar configured to support a log; and a ratcheting arm having a first arm end pivotably coupled to the support bar, the ratcheting arm having a plurality of spaced-apart teeth between said first arm end and a second arm end, said teeth defining notches adapted and positioned to selectively engage with the rod;

wherein selective engagement of the teeth with the rod enables pivotal adjustment and releasable locking of the support bar relative to the baseplate during operation.

12. The adjustable toe board assembly of claim 11, wherein the first end of the baseplate is secured proximate the first bunk end of the corresponding cross bunk, the pivotal movement of the support bar above the corresponding cross bunk in operation directing the log towards the side support.

13. The adjustable toe board according to claim 11, wherein the teeth slope towards the second arm end.

14. The adjustable toe board according to claim 13, wherein the teeth have an arcuate profile.

15. The adjustable toe board according to claim 11, wherein the ratcheting arm is curved and convex along the plurality of spaced-apart teeth.

16. The adjustable toe board assembly according to claim 11, wherein the spaced-apart teeth are adapted to enable movement of the ratcheting arm in one direction when the toe board is releasably-locked in position during operation.

17. The adjustable toe board assembly according to claim 11, wherein the support bar includes a handle.

18. The adjustable toe board assembly according to claim 11, wherein the ratcheting arm includes a handgrip.

19. A sawmill, comprising:

a framework having a cross bunk;

an adjustable toe board coupled to the cross bunk, the toe board comprising:

a baseplate having a first end and a second end, and a rod extending from the baseplate, a support bar pivotably coupled to the baseplate proximate the first end, spaced apart from the rod, and extending towards the second end, the support bar configured to support a log; and a ratcheting arm having a first arm end pivotably coupled to the support bar, the ratcheting arm having a plurality of spaced-apart teeth defining notches adapted and positioned between the first arm end and a second arm end to selectively engage with the rod;

wherein selective engagement of the teeth with the rod enables pivotal movement and releasable locking of the support bar relative to the baseplate above the cross bunk during operation.

20. The sawmill according to claim 19, wherein the teeth slope towards the second arm end.

21. The sawmill according to claim 20, wherein the teeth have an arcuate profile.

22. The sawmill according to claim 19, wherein the ratcheting arm is curved and convex along the plurality of spaced-apart teeth.

23. The sawmill according to claim 19, wherein the teeth are adapted to enable movement of the ratcheting arm in one direction when the toe board is releasably-locked in position during operation.

* * * * *